US010532258B2

(12) United States Patent
Seluga et al.

(10) Patent No.: US 10,532,258 B2
(45) **Date of Patent: *Jan. 14, 2020**

(54) GOLF CLUB HEAD HAVING STRESS-REDUCING FEATURES

(71) Applicant: Callaway Golf Company, Carlsbad, CA (US)

(72) Inventors: James A. Seluga, Carlsbad, CA (US); Matthew Myers, Carlsbad, CA (US); Matthew Hannen, Carlsbad, CA (US); Bart R. Fliers, Vista, CA (US); Robert S. Gonczi, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,491

(22) Filed: May 14, 2019

(65) Prior Publication Data

US 2019/0262672 A1 Aug. 29, 2019

Related U.S. Application Data

(60) Division of application No. 15/912,247, filed on Mar. 5, 2018, now Pat. No. 10,335,647, which is a (Continued)

(51) Int. Cl.
*A63B 53/04* (2015.01)
*A63B 60/02* (2015.01)
(Continued)

(52) U.S. Cl.
CPC ..... *A63B 53/0466* (2013.01); *A63B 60/02* (2015.10); *A63B 60/52* (2015.10);
(Continued)

(58) Field of Classification Search
CPC ..... A63B 53/0466; A63B 60/02; A63B 2053/0408; A63B 2053/0454;
(Continued)

(56) References Cited

U.S. PATENT DOCUMENTS 9,486,677 B1 * 11/2016 Seluga ..... A63B 53/0466
9,597,558 B1 * 3/2017 Seluga ..... A63B 53/0466
(Continued)

*Primary Examiner* — Sebastiano Passaniti
(74) *Attorney, Agent, or Firm* — Rebecca Hanovice; Michael Catania; Sonia Lari

(57) ABSTRACT

The present invention is directed to a body for a golf club head that includes structural columns or connectors, also referred to as stiffening members, and particularly a pair of solid rods, that extend between a return section and a sole section approximately parallel with a rear surface of a striking face section and parallel with each other without touching the rear surface or one another, even during impact with a golf ball. Each of the solid rods preferably is cylindrical, has a diameter of 0.050 inch to 0.200 inch, and has a length of 1 to 2.5 inches. Each of the rods has an upper end and a lower end. The solid rods preferably have a variable diameter to reduce their overall mass, such that the upper ends and lower ends have diameters that are larger than, and taper towards, a midpoint of the solid rods so that the solid rods each has an approximate hourglass shape.

10 Claims, 5 Drawing Sheets

Related U.S. Application Data continuation of application No. 15/808,025, filed on Nov. 9, 2017, now Pat. No. 9,931,550, and a continuation-in-part of application No. 15/628,514, filed on Jun. 20, 2017, now Pat. No. 9,908,017, which is a continuation of application No. 15/447,638, filed on Mar. 2, 2017, now Pat. No. 9,687,702, said application No. 15/808,025 is a continuation-in-part of application No. 15/637,902, filed on Jun. 29, 2017, now Pat. No. 9,981,167, which is a continuation of application No. 15/446,754, filed on Mar. 1, 2017, now Pat. No. 9,694,257, which is a continuation-in-part of application No. 15/279,188, filed on Sep. 28, 2016, now Pat. No. 9,687,701, said application No. 15/447,638 is a continuation-in-part of application No. 15/279,188, filed on Sep. 28, 2016, now Pat. No. 9,687,701, which is a continuation of application No. 14/847,227, filed on Sep. 8, 2015, now Pat. No. 9,486,677, which is a continuation-in-part of application No. 14/788,326, filed on Jun. 30, 2015, now Pat. No. 9,597,558.

(60) Provisional application No. 62/442,892, filed on Nov. 5, 2017.

(51) Int. Cl.

| | |
|---|---|
| ***B21K 17/00*** | (2006.01) |
| ***B22C 7/02*** | (2006.01) |
| ***B22C 9/24*** | (2006.01) |
| ***A63B 60/52*** | (2015.01) |
| *A63B 60/42* | (2015.01) |

(52) U.S. Cl.

CPC ..... *B21K 17/00* (2013.01); *B22C 7/02* (2013.01); *B22C 9/24* (2013.01); *A63B 53/047* (2013.01); *A63B 60/42* (2015.10); *A63B 2053/045* (2013.01); *A63B 2053/0408* (2013.01); *A63B 2053/0412* (2013.01); *A63B 2053/0433* (2013.01); *A63B 2053/0437* (2013.01); *A63B 2053/0454* (2013.01); *A63B 2053/0458* (2013.01); *A63B 2053/0491* (2013.01); *A63B 2209/00* (2013.01)

(58) Field of Classification Search

CPC .... A63B 2053/0491; A63B 2053/0437; A63B 2053/0412; A63B 2053/0433; A63B 2053/0458; A63B 2053/045; A63B 53/047

USPC ..... 473/324–350, 287–292

See application file for complete search history.

(56) References Cited

U.S. PATENT DOCUMENTS

| | | | | |
|---|---|---|---|---|
| 9,597,561 | B1 * | 3/2017 | Seluga | A63B 53/06 |
| 9,687,701 | B1 * | 6/2017 | Seluga | A63B 53/0466 |
| 9,687,702 | B1 * | 6/2017 | Seluga | A63B 53/0466 |
| 9,694,257 | B1 * | 7/2017 | Seluga | A63B 53/0475 |
| 9,757,629 | B2 * | 9/2017 | Seluga | A63B 53/0466 |
| 9,776,058 | B2 * | 10/2017 | Seluga | A63B 53/0466 |
| 9,814,947 | B1 * | 11/2017 | Seluga | A63B 53/0466 |
| 9,821,199 | B1 * | 11/2017 | Seluga | A63B 53/0466 |
| 9,827,469 | B1 * | 11/2017 | Seluga | A63B 53/0466 |
| 9,855,476 | B2 * | 1/2018 | Seluga | A63B 53/0466 |
| 9,889,349 | B1 * | 2/2018 | Seluga | A63B 53/0466 |
| 9,908,016 | B2 * | 3/2018 | Seluga | A63B 53/0466 |
| 9,908,017 | B2 * | 3/2018 | Seluga | A63B 53/0466 |
| 9,931,549 | B1 * | 4/2018 | Seluga | A63B 53/0466 |
| 9,931,550 | B1 * | 4/2018 | Seluga | B22C 9/24 |
| 9,981,167 | B2 * | 5/2018 | Seluga | A63B 53/0475 |
| 9,987,527 | B1 * | 6/2018 | Myers | A63B 53/0466 |
| 10,010,771 | B2 * | 7/2018 | Seluga | A63B 53/0466 |
| 10,065,085 | B2 * | 9/2018 | Seluga | A63B 53/0466 |
| 10,201,733 | B2 * | 2/2019 | Seluga | A63B 53/0475 |
| 10,213,661 | B2 * | 2/2019 | Seluga | A63B 53/0466 |
| 10,213,662 | B2 * | 2/2019 | Seluga | A63B 53/0466 |
| 10,238,933 | B1 * | 3/2019 | Seluga | A63B 53/06 |
| 10,335,647 | B2 * | 7/2019 | Seluga | A63B 60/52 |
| 10,406,408 | B1 * | 9/2019 | Seluga | A63B 53/0466 |

* cited by examiner

GOLF CLUB HEAD HAVING STRESS-REDUCING FEATURES

CROSS REFERENCES TO RELATED APPLICATIONS

The present invention is a divisional of U.S. patent application Ser. No. 15/912,247, filed on Mar. 5, 2018, which is a continuation of U.S. patent application Ser. No. 15/808,025, filed on Nov. 9, 2017, and issued on Apr. 3, 2018, as U.S. Pat. No. 9,931,550, which claims priority to U.S. Provisional Patent Application No. 62/442,892, filed on Jan. 5, 2017, and is also a continuation-in-part of U.S. patent application Ser. No. 15/628,514, filed on Jun. 20, 2017, and issued on Mar. 6, 2018, as U.S. Pat. No. 9,908,017, which is a continuation of U.S. patent application Ser. No. 15/447,638, filed on Mar. 2, 2017, and issued on Jun. 27, 2017 as U.S. Pat. No. 9,687,702, the disclosure of each of which is hereby incorporated by reference in its entirety herein. U.S. patent application Ser. No. 15/808,025 is also a continuation-in-part of U.S. patent application Ser. No. 15/637,902, filed on Jun. 29, 2017, and issued on May 29, 2018, as U.S. Pat. No. 9,981,167, which is a continuation of U.S. patent application Ser. No. 15/446,754, filed on Mar. 1, 2017, and issued on Jul. 4, 2017, as U.S. Pat. No. 9,694,257, the disclosure of each of which is hereby incorporated by reference in its entirety herein. Each of U.S. patent application Ser. Nos. 15/446,754 and 15/447,638 is a continuation-in-part of U.S. patent application Ser. No. 15/279,188, filed on Sep. 28, 2016, and issued on Jun. 27, 2017, as U.S. Pat. No. 9,687,701, which is a continuation of U.S. patent application Ser. No. 14/857,227, filed on Sep. 8, 2015, and issued Nov. 8, 2016, as U.S. Pat. No. 9,486,677, which is a continuation-in-part of U.S. patent application Ser. No. 14/788,326, filed on Jun. 30, 2015, and issued on Mar. 21, 2017, as U.S. Pat. No. 9,597,558, and which is also a continuation-in-part of U.S. patent application Ser. No. 14/794,578, filed on Jul. 8, 2015, and issued on Nov. 14, 2017, as U.S. Pat. No. 9,814,947, which is a continuation-in-part of U.S. patent application Ser. No. 14/755,068, filed on Jun. 30, 2015, and issued on Apr. 18, 2017, as U.S. Pat. No. 9,623,302, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012, the disclosure of each of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a method of manufacturing a golf club head with stress-reducing features, the stress-reducing features connecting a crown portion with a sole portion via a hollow interior and disposed proximate a striking face section.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The present invention is directed to a method of manufacturing a golf club head comprising interior structures connecting a return section to a sole section to reduce the stress in a striking face section during impact with a golf ball. The interior structures are solid rods that are co-cast with a body portion of the golf club head via a wax-welding processes.

One aspect of the present invention is a method comprising preparing a wax of a golf club head body, the wax of the golf club head body comprising a striking face section, a sole section extending from a lower edge of the striking face section, and a return section extending from an upper edge of the striking face section, the striking face section, sole section, and return section defining a hollow body interior, the return section comprising a through-hole, and the sole section comprising a receiving pocket, preparing a wax of a solid rod comprising an upper end and a lower end, inserting the solid rod into the through-hole and seating the lower end in the receiving pocket, bonding the solid rod to the body with an adhesive material to form a combined wax mold, and casting a golf club head from the combined wax mold, wherein the through-bore is aligned with the receiving pocket, wherein the solid rod is cylindrical and has a diameter of 0.050 inch to 0.200 inch, wherein the solid rod is located within 1 inch of a rear surface of the striking face section measured along a vertical plane extending through a face center perpendicular to the striking face section, and wherein no portion of the solid rod makes contact with the striking face section.

In some embodiments the rod may be spaced a distance of no more than 0.210 inch from the rear surface. In other embodiments, the step of bonding the solid rod to the body may comprise applying glue around an entire circumference of each of the upper and lower ends of the solid rod. In still other embodiments, the method may include a further step of applying hot wax to the upper end of the solid rod to seal it to the return section, which step may occur after the step of bonding the solid rod to the body. In any of the embodiments, the step of casting a golf club head from the combined wax mold may comprise casting the golf club head from a titanium alloy. In some of the embodiments, the wax of the golf club head body may comprise at least one cutout in a center area of the sole section. In other embodiments, the striking face section may comprise a varying thickness. In still other embodiments, the wax of the golf club head body may comprise a shallow depression extending into an outer surface of the sole section, and the shallow depression may be aligned with the receiving pocket.

Another aspect of the present invention is a method comprising preparing a wax of a golf club head body, the wax of the golf club head body comprising a striking face section, a sole section extending from a lower edge of the striking face section, and a return section extending from an upper edge of the striking face section, the striking face section, sole section, and return section defining a hollow body interior, the return section comprising a receiving pocket, and the sole section comprising a through-bore, preparing a wax of a solid rod comprising an upper end and a lower end, inserting the solid rod into the through-hole and seating the upper end in the receiving pocket so that the solid rod is located within 1 inch of a rear surface of the striking face section measured along a vertical plane extending through a face center perpendicular to the striking face section, bonding the solid rod to the body with an adhesive material to form a combined wax mold, and casting a golf club head from the combined wax mold, wherein the through-bore is aligned with the receiving pocket, wherein the solid rod has a diameter of 0.050 inch to 0.200 inch and a length of 1 inch to 2.5 inches, and wherein no portion of the solid rod makes contact with the striking face section.

In some embodiments, the step of bonding the solid rod to the body may comprise applying glue around an entire circumference of each of the upper and lower ends of the solid rod. In a further embodiment, the method may include the step of applying hot wax to the lower end of the solid rod to seal it to the sole section, which step may occur after the step of bonding the solid rod to the body. In another embodiment, the step of casting a golf club head from the combined wax mold may comprise casting the golf club head from a titanium alloy.

Yet another aspect of the present invention is a method comprising preparing a wax of a golf club head body, the golf club head body comprising a striking face section, a sole section extending from a lower edge of the striking face section, and a return section extending from an upper edge of the striking face section, the striking face section, sole section, and return section defining a hollow body interior, the return section comprising first and second through-holes, and the sole section comprising first and second receiving pockets, preparing a wax of first and second solid rods, the first solid rod comprising a first upper end and a first lower end, and the second solid rod comprising a second upper end and a second lower end, inserting the first solid rod into the first through-hole and seating the first lower end in the first receiving pocket, inserting the second solid rod into the second through-hole and seating the second lower end in the second receiving pocket, bonding each of the first and second solid rods to the body with an adhesive material to form a combined wax mold, and casting a golf club head from the combined wax mold using a titanium alloy material, wherein each of the first and second solid rods is located within 1 inch of a rear surface of the striking face section measured along a vertical plane extending through a face center perpendicular to the striking face section, and wherein no portion of the first and second solid rods makes contact with the striking face section.

In some embodiments, the method may further comprise the step of applying hot wax to the first and second upper ends, which step may occur after the step of bonding each of the first and second solid rods to the body. In another embodiment, the step of bonding each of the first and second solid rods to the body with an adhesive material to form a combined wax mold may comprise applying glue around an entire circumference of the first and second upper ends and the first and second lower ends. In yet another embodiment, each of the first and second upper ends may be spaced a first distance from the rear surface, each of the first and second lower ends may be spaced a second distance from the rear surface, and the second distance may be greater than the first distance. In a further embodiment, the first distance may be 0.120 inch to 0.150 inch, and the second distance may 0.180 inch to 0.210 inch. In another embodiment, the first solid rod may be spaced a distance of 0.500 inch to 2.00 inch from the second solid rod. In any of the embodiments, at least one of the first and second solid rods may extend through the hollow body interior approximately parallel with the rear surface, and the first solid rod may be approximately parallel with the second solid rod.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to a method of manufacturing a body for a golf club head that includes structural columns or connectors, also referred to as stiffening members, and particularly a pair of solid rods, that extend between a return section and a sole section approximately parallel with a rear surface of a striking face section and with each other without touching the rear surface or one another, even during impact with a golf ball. In particular, the present invention is a method of co-casting the structural connectors or rods with the body.

Figure 1:
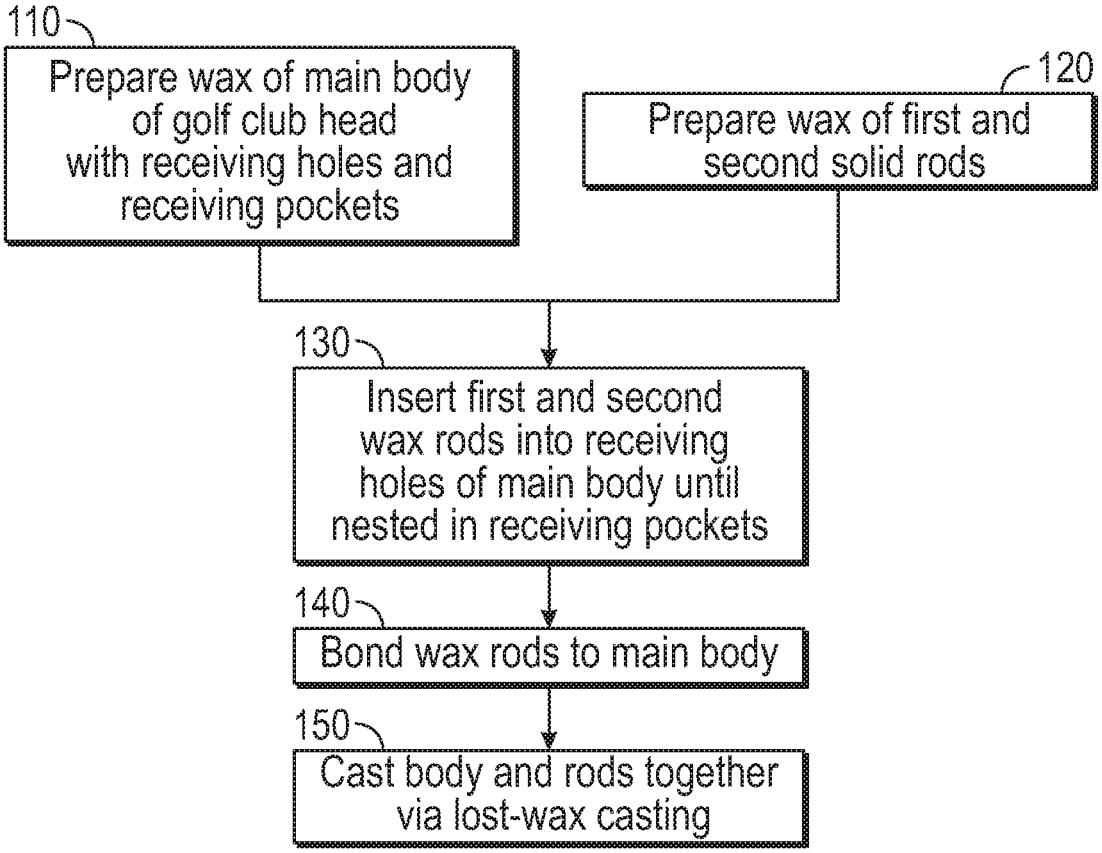
FIG. 1 is a flow chart describing the process of co-casting rods with a golf club head body of the present invention.
Figure 2:
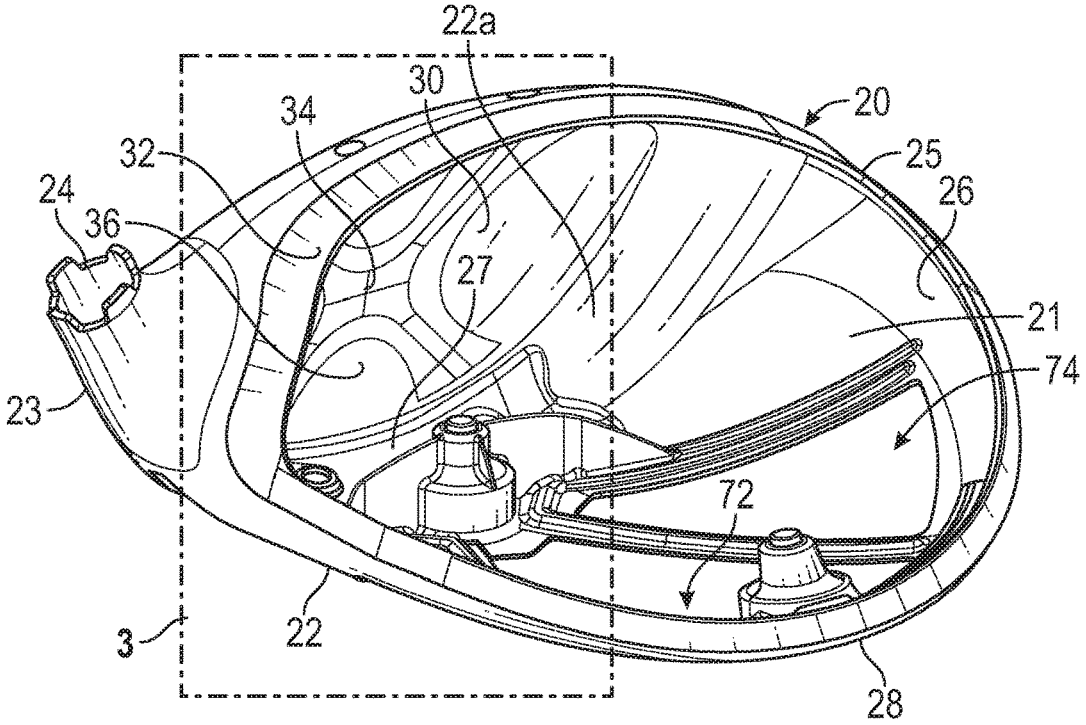
FIG. 2 is a top perspective view of a wax mold of the golf club head body of the present invention.
Figure 3:
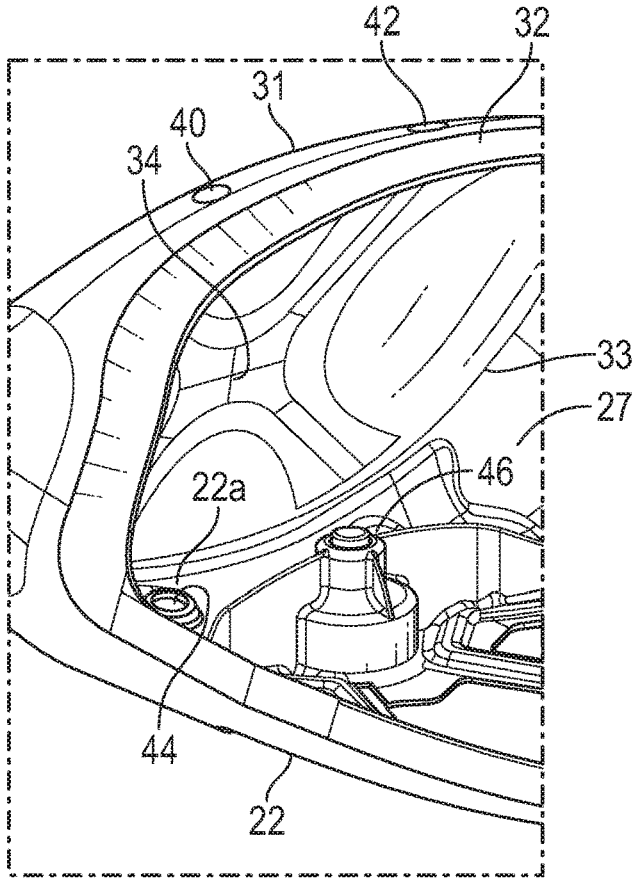
FIG. 3 is an enlarged view of the circled portion of the wax mold shown in FIG. 2.
Figure 4:
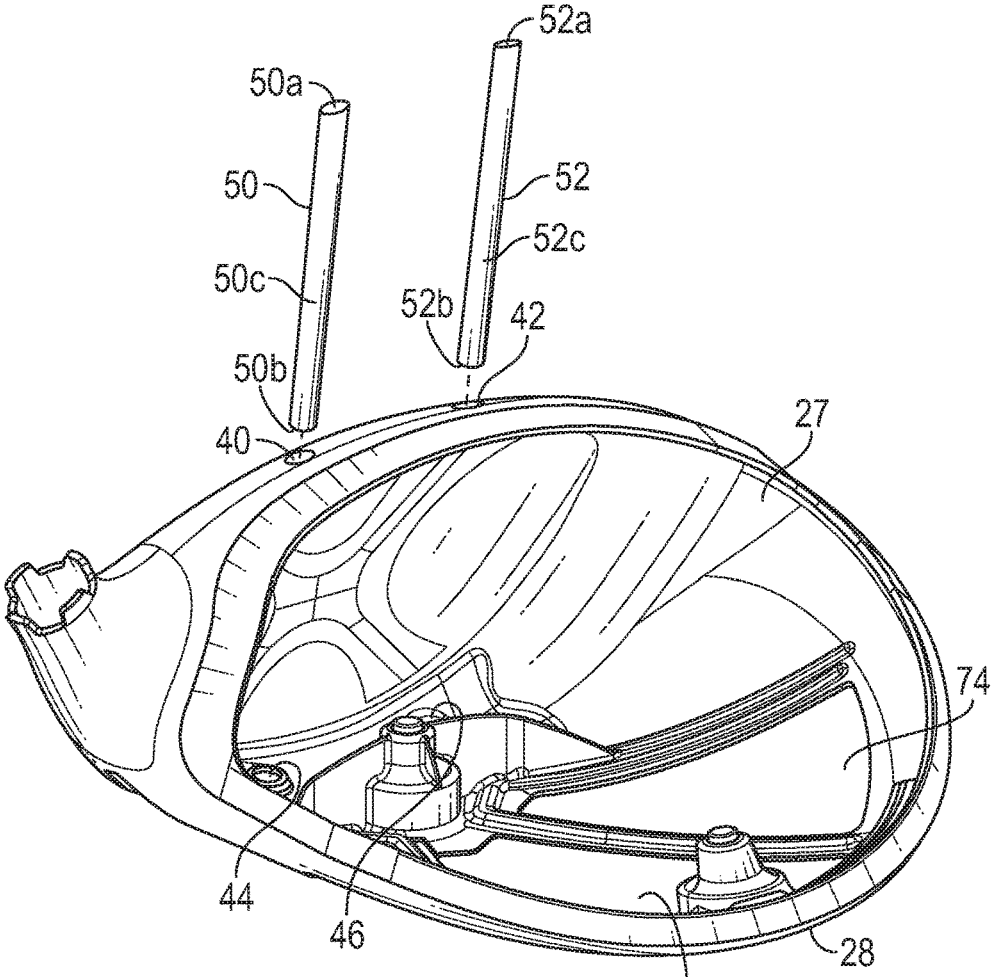
FIG. 4 is an exploded view of the wax mold shown in FIG. 2 with two wax rods.
Figure 5:
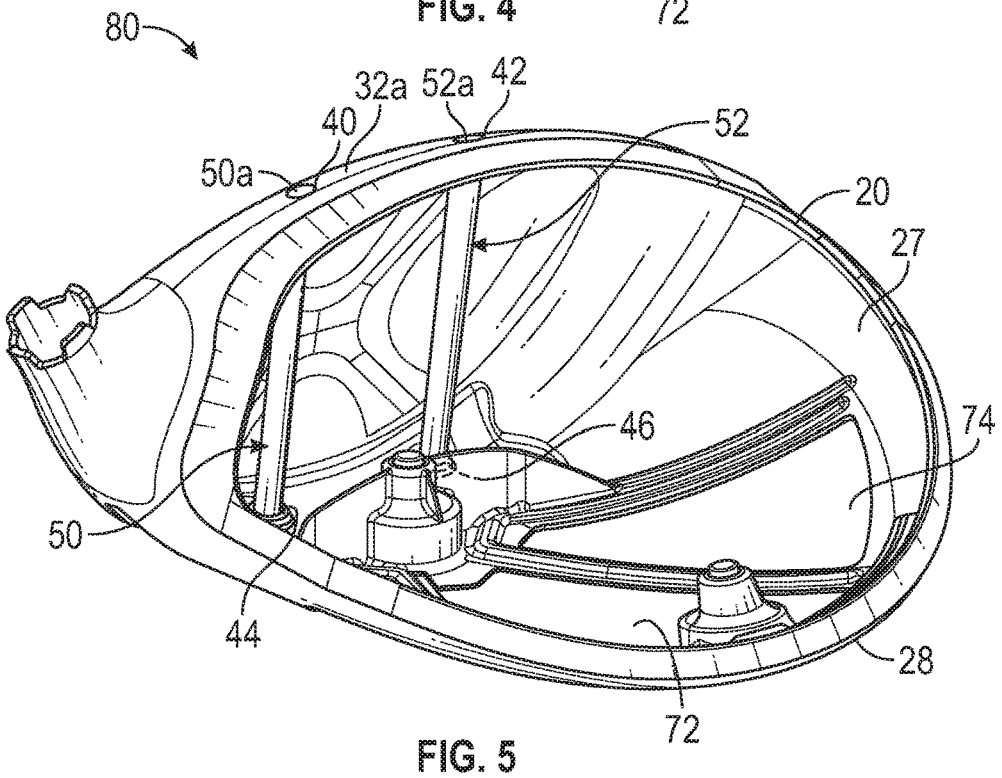
FIG. 5 is a top perspective, assembled view of the wax mold shown in FIG. 4.
Figure 6:
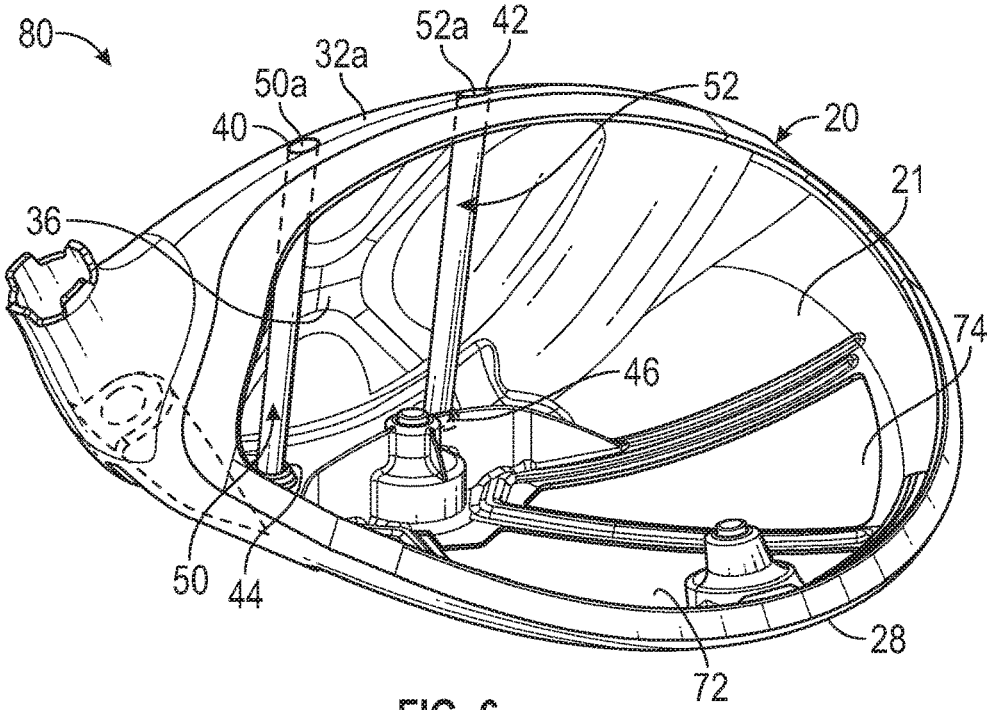
FIG. 6 is a partially transparent view of the wax mold shown in FIG. 5.
Figure 7:
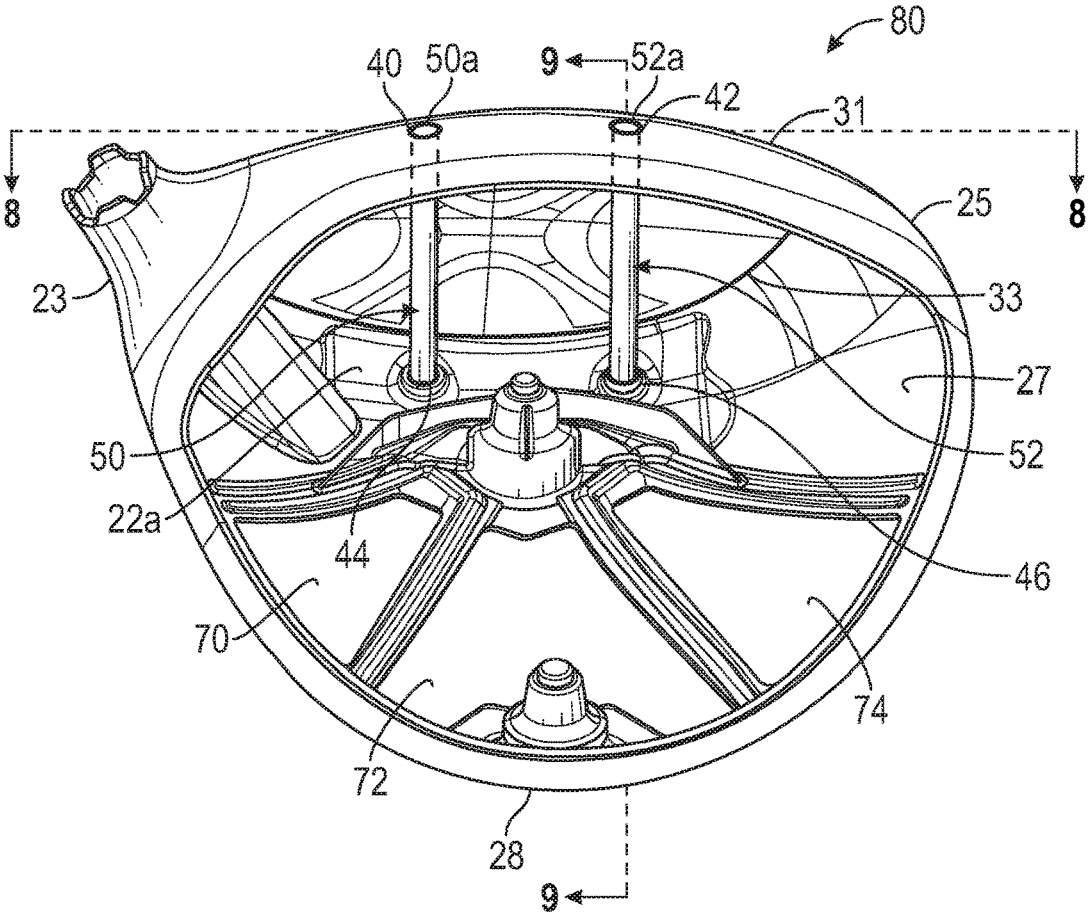
FIG. 7 is a top perspective, partially transparent view of the wax mold shown in FIG. 6.
Figure 8:
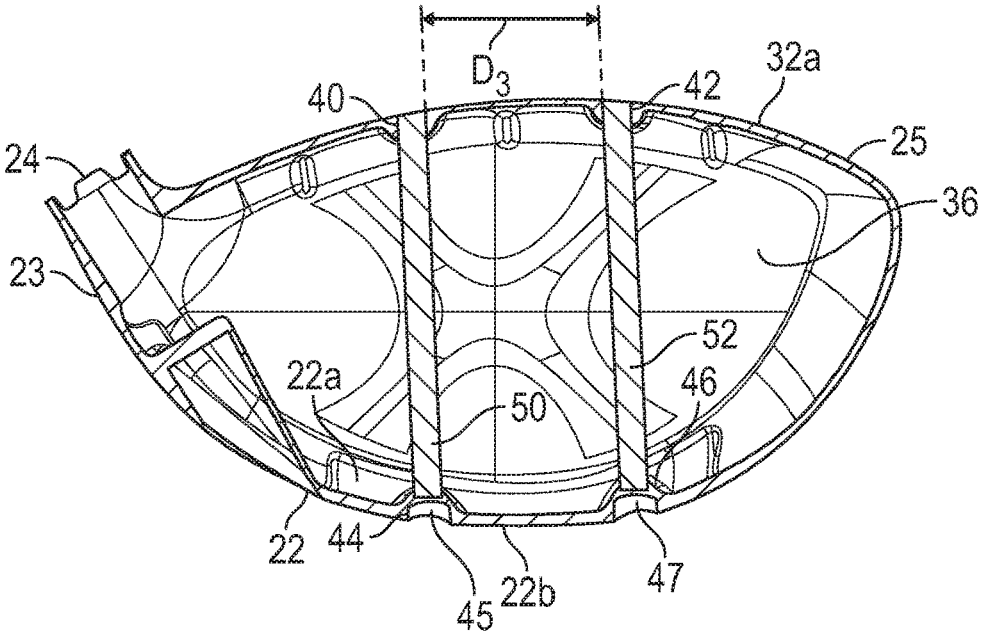
FIG. 8 is a cross-sectional view of the wax mold shown in FIG. 7 along lines 8-8.
Figure 9:
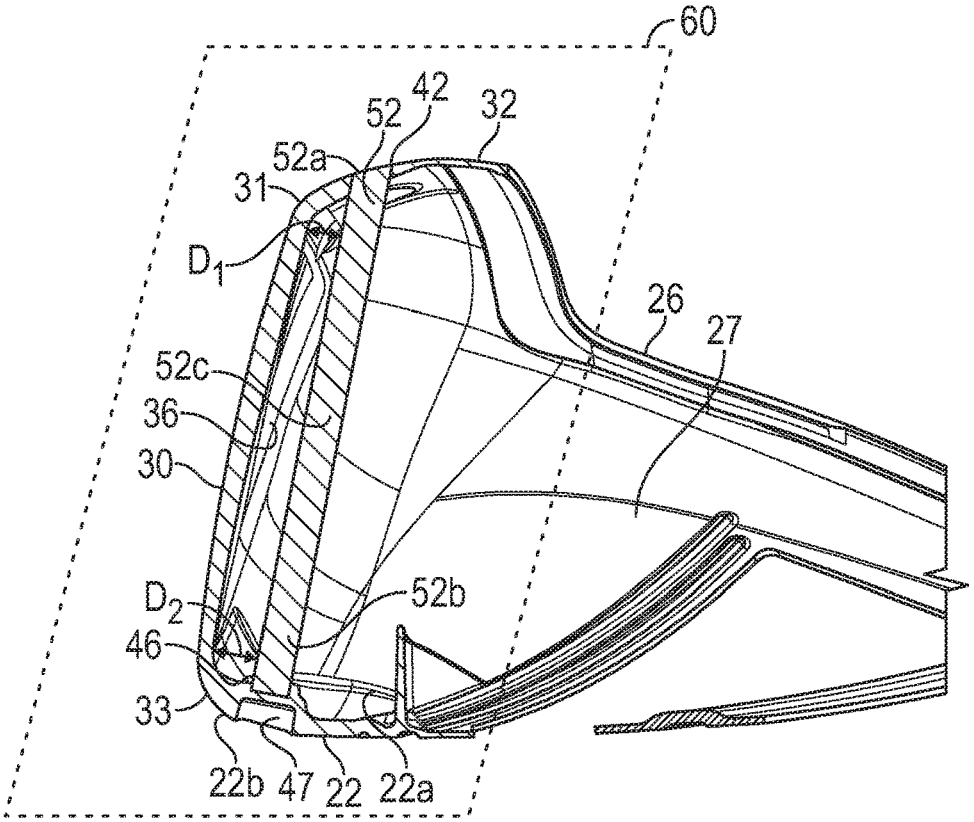
FIG. 9 is a cross-sectional view of the wax mold shown in FIG. 7 along lines 9-9.

As illustrated in FIG. 1, the preferred method includes a first step of preparing a wax of the main body 110. As shown in FIGS. 2-9, the wax of the main body 20 preferably has a striking face section 30 with a face center 34 and a rear surface 36, a return section 32 extending rearwards away from an upper edge 31 of the striking face section 30, a sole section 22 extending rearwards away from a lower edge 33 of the striking face section 30, a hosel 24 for engaging a shaft, a heel end 23, a toe end 25, an upper opening 26, a hollow interior 27, and an aft end 28. A pair of bores 40, 42 extends through the return section 32 and communicates with the hollow interior 27; each bore 40, 42 is aligned with one of a pair of receiving pockets 44, 46 extending from an interior surface 22*a* of the sole section 22 into the hollow interior 27. As shown in FIGS. 8 and 9, shallow depressions 45, 47 extend into an outer surface 22*b* of the sole section 22 and are aligned with the receiving pockets 44, 46 to indicate their locations within the hollow interior 27. This orientation can be reversed in an alternative embodiment, such that the bores 40, 42 extend through the sole section 22 and the receiving pockets 44, 46 extend from the return section 32 into the hollow interior 27. The body 20 also includes three cutouts 70, 72, 74 in a center area 21 of the sole section 22.

The body 20 preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 450 to 460 cubic centimeters. The striking face section 30 preferably has a varying thickness such as that described in U.S. Pat. No. 7,448,960, for a Golf Club Head With Variable Face Thickness, which is hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which are hereby incorporated by reference. Alternatively, the striking face section 30 may have a uniform thickness.

The second step, preparing a wax of first and second solid rods 120, can be performed at the same time as the first step 110. Each of the solid rods 50, 52 preferably is cylindrical, has a diameter of 0.050 inch to 0.200 inch, and has a length of 1 to 2.5 inches. Each of the rods 50, 52 also has an upper end 50*a*, 52*a* and a lower end 50*b*, 52*b*. The solid rods 50, 52 preferably have a variable diameter to reduce their overall mass, such that the upper ends 50*a*, 52*a* and lower ends 50*b*, 52*b* have diameters that are larger than, and taper towards, a midpoint 50*c*, 52*c* of the solid rods 50, 52, so that the solid rods 50, 52 each has an approximate hourglass shape. In a preferred embodiment, the upper ends 50*a*, 52*a* and lower ends 50*b*, 52*b* have a diameter of 0.140 to 0.170 inch, while the midpoints 50*c*, 52*c* have a diameter of 0.100 to 0.125 inch.

Once the waxes of the main body 20 and the solid rods 50, 52 have been prepared, the third step 130 of the method is performed: the first solid rod wax 50 is inserted through the first bore 40 until the lower end 50*b* seats in the first receiving pocket 44, and the second solid rod wax 52 is inserted through the second bore 42 until the lower end 52*b* seats in the second receiving pocket 46. The bores 40, 42 and receiving pockets 44, 46 preferably are oriented such that, when engaged with the body 20, each rod 50, 52 is closer to the striking face section 30 than to an aft end 28 of the body 20. More preferably, the rods 50, 52 are both located within 1 inch of the rear surface 36 of the striking face section 30 measured along a vertical plane 60 extending through the face center 34 perpendicular to the striking face section 30. No portion of either rod 50, 52 should be located outside of this 1-inch range; in fact, it is more preferable for each rod 50, 52 to be located even closer to the rear surface 36 of the striking face section 30, e.g., 0.136 inch to 0.210 inch from the rear surface 36, with the upper end 50*a*, 52*a* of each rod 50, 52 spaced a distance $D_1$ that is slightly closer to the rear surface 36 than the spacing $D_2$ of the lower end 50*b*, 52*b*, as shown in FIG. 9. In the preferred embodiment, $D_1$ ranges from 0.120 inch to 0.150 inch, while $D_2$ ranges from 0.180 inch to 0.210 inch. As shown in FIG. 8, the rods 50, 52 are also spaced from one another by a distance $D_3$ of 0.500 to 2.00 inch, more preferably approximately 0.75 to 1.50 inch, and most preferably approximately 1.00 inch.

In the fourth step 140, the wax solid rods 50, 52 are bonded to the wax of the main body 20, preferably using a glue and hot wax, such that the upper ends 50*a*, 52*a* of the solid rods 50, 52 are flush with an upper surface 32*a* of the return section 32 as shown in FIG. 8. In particular, glue is applied around the entire circumference of each rod 50, 52 so that it has a 360° bond to the body 20 at each connection point between the solid rods 50, 52 and the wax body 20, i.e., at the bores 40, 42 and the receiving pockets 44, 46. Hot wax is then use to melt the upper ends 50*a*, 52*a* of the rods 50, 52 and seal them to the return section 32.

The resulting combined wax mold 80 is then used to cast the body via lost-wax casting 150. The metal used for this step preferably is titanium or a titanium alloy such as 6-4 titanium alloy, alpha-beta titanium alloy or beta titanium alloy for forging, and 6-4 titanium for casting. Alternatively, the body 20 is composed of 17-4 steel alloy.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a cast metal body comprising;

a striking face section having an exterior surface, an interior surface, an upper perimeter and a lower perimeter;

a crown return portion extending rearward from the upper perimeter of the striking face section;

a sole section portion extending rearward from the lower perimeter of the striking face section;

a first solid rod comprising a first upper end, a first midpoint, and a first lower end; and a second solid rod comprising a second upper end, a second midpoint, and a second lower end, wherein each of the first upper end and the second upper end is connected to the crown return portion, wherein each of the first lower end and the second lower end is connected to the sole section, wherein each of the first solid rod and the second solid rod is positioned approximately parallel with the interior surface of the striking face section, wherein the first solid rod and the second solid rod extend parallel to one other, wherein each of the first solid rod and the second solid rod is spaced from 0.136 inch to 0.210 inch from the interior surface of the striking face section, wherein no portion of the first solid rod and the second solid rod makes contact with the striking face section, and wherein each of the first solid rod and the second solid rod has a variable diameter.

2. The golf club head of claim 1, each of the first solid rod and the second solid rod has an approximately hourglass shape.

3. The golf club head of claim 2, wherein each of the first upper end, second upper end, first lower end, and second lower end has a diameter of 0.140 inch to 0.170 inch, and wherein each of the first midpoint and second midpoint has a diameter of 0.100 inch to 0.125 inch.

4. The golf club head of claim 1, wherein each of the first solid rod and the second solid rod has a length of 1 inch to 2.5 inches, wherein the body has a volume of 420 cubic centimeters to 470 cubic centimeters, and wherein the striking face section has a variable thickness.

5. The golf club head of claim 1, wherein the first solid rod is spaced from the second solid rod by a distance of 0.75 inch to 1.50 inch.

6. The golf club head of claim 5, wherein the first solid rod is spaced from the second solid rod by a distance of approximately 1.00 inch.

7. A golf club head comprising:

a cast titanium alloy body comprising;

a variable thickness striking face section having an exterior surface, an interior surface, an upper perimeter and a lower perimeter;

a crown return portion extending rearward from the upper perimeter of the striking face section;

a sole section portion extending rearward from the lower perimeter of the striking face section;

a first solid rod comprising a first upper end, a first midpoint, and a first lower end; and a second solid rod comprising a second upper end, a second midpoint, and a second lower end, wherein each of the first upper end and the second upper end is connected to the crown return portion, wherein each of the first lower end and the second lower end is connected to the sole section, wherein each of the first upper end, second upper end, first lower end, and second lower end has a diameter of 0.140 inch to 0.170 inch, wherein each of the first midpoint and second midpoint has a diameter of 0.100 inch to 0.125 inch, wherein each of the first solid rod and the second solid rod is positioned approximately parallel with the interior surface of the striking face section, wherein the first solid rod and the second solid rod extend parallel to one other, wherein each of the first solid rod and the second solid rod is spaced from 0.120 inch to 0.210 inch from the interior surface of the striking face section, wherein no portion of the first solid rod and the second solid rod makes contact with the striking face section, wherein the first solid rod is spaced from the second solid rod by a distance of approximately 1.00 inch, wherein each of the first solid rod and the second solid rod has an approximately hourglass shape.

8. The golf club head of claim 7, wherein each of the first solid rod and the second solid rod has a length of 1 inch to 2.5 inches.

9. The golf club head of claim 7, wherein the body has a volume of 420 cubic centimeters to 470 cubic centimeters.

10. The golf club head of claim 7, wherein the titanium alloy is 6-4 titanium alloy.

* * * * *